US009726196B2

(12) United States Patent
Gilarranz et al.

(10) Patent No.: US 9,726,196 B2
(45) Date of Patent: Aug. 8, 2017

(54) SYSTEM AND COOLING FOR RAPID PRESSURIZATION OF A MOTOR-BEARING COOLING LOOP FOR A HERMETICALLY SEALED MOTOR/COMPRESSOR SYSTEM

(75) Inventors: Jose L. Gilarranz, Katy, TX (US); David J. Peer, Olean, NY (US); Steven Rockwood, Allegany, NY (US)

(73) Assignee: Dresser-Rand Company, Olean, NY (US)

( * ) Notice: Subject to any disclaimer, the term of this patent is extended or adjusted under 35 U.S.C. 154(b) by 1008 days.

(21) Appl. No.: 13/880,846

(22) PCT Filed: Oct. 19, 2011

(86) PCT No.: PCT/US2011/056891

§ 371 (c)(1),
(2), (4) Date: Oct. 15, 2013

(87) PCT Pub. No.: WO2012/058069

PCT Pub. Date: May 3, 2012

(65) Prior Publication Data

US 2014/0037422 A1 Feb. 6, 2014

Related U.S. Application Data

(60) Provisional application No. 61/407,142, filed on Oct. 27, 2010.

(51) Int. Cl.
*F04D 29/58* (2006.01)
*F04D 17/12* (2006.01)
(Continued)

(52) U.S. Cl.
CPC ..... *F04D 29/58* (2013.01); *F04D 17/12* (2013.01); *F04D 25/0686* (2013.01);
(Continued)

(58) Field of Classification Search
CPC ..... F04D 29/58; F04D 29/102; F04D 29/104; F04D 29/124; F04D 29/083; F04D 29/10;
(Continued)

(56) References Cited

U.S. PATENT DOCUMENTS 4,057,371 A * 11/1977 Pilarczyk ..... F01D 25/166 417/409
5,267,452 A 12/1993 Zinsmeyer et al.
(Continued)

FOREIGN PATENT DOCUMENTS

EP 1008759 A1 6/2000
EP 1914429 A2 4/2008
(Continued)

OTHER PUBLICATIONS

PCT/US/2011/56891—Notification of Transmittal of International Preliminary Report on Patentability, International Preliminary Report on Patentability, dated Dec. 18, 2012.
(Continued)

*Primary Examiner* — Cassey D Bauer

(57) ABSTRACT

A system and method for rapid pressurization of a motor compartment and cooling system during a shutdown, a surge, and/or other situations in which the suction pressure significantly varies. A motor/compressor arrangement includes a seal gas system fluidly communicating with the motor compartment via a motor pressurization line, with the outlet of the compressor, and with a shaft seal. A motor pressurization valve is coupled to the motor pressurization line and a controller is configured to open the motor pressurization valve at start-up of the motor-compressor to supply seal gas to the motor compartment and to pressurize the motor compartment when a difference between the seal gas supply pressure and the suction pressure is indicative of the seal gas supply pressure being insufficient.

10 Claims, 3 Drawing Sheets

(51) Int. Cl.

| | |
|---|---|
| ***F04D 25/06*** | (2006.01) |
| ***F04D 27/02*** | (2006.01) |
| ***F04D 29/058*** | (2006.01) |
| ***F04D 29/12*** | (2006.01) |

(52) U.S. Cl.
CPC ..... *F04D 27/0292* (2013.01); *F04D 29/058* (2013.01); *F04D 29/124* (2013.01); *F04D 29/584* (2013.01); *F05D 2260/85* (2013.01)

(58) Field of Classification Search
CPC ... F04D 25/082; F04D 25/5806; H02K 5/124; F25B 31/006
See application file for complete search history.

(56) References Cited

U.S. PATENT DOCUMENTS

| | | | | |
|---|---|---|---|---|
| 5,584,673 | A | 12/1996 | Rein | |
| 6,102,672 | A | 8/2000 | Woollenweber et al. | |
| 6,126,411 | A | 10/2000 | Flanigan et al. | |
| 6,394,764 | B1 | 5/2002 | Samurin | |
| 6,931,983 | B2 | 8/2005 | Meucci | |
| 2002/0028145 | A1* | 3/2002 | Samurin | F04D 29/162 417/313 |
| 2005/0142004 | A1* | 6/2005 | Appleford | F04D 25/06 417/371 |
| 2007/0212232 | A1* | 9/2007 | De Larminat | F04C 29/045 417/83 |
| 2008/0078286 | A1* | 4/2008 | Gray | F15B 1/024 91/461 |
| 2008/0260539 | A1* | 10/2008 | Stinessen | F04D 25/0686 417/26 |

FOREIGN PATENT DOCUMENTS

| | | | |
|---|---|---|---|
| EP | 2103810 | A1 | 9/2009 |
| WO | 03035225 | A1 | 5/2003 |
| WO | 2005003512 | A1 | 1/2005 |
| WO | 2007055591 | A1 | 5/2007 |
| WO | 2008002148 | A1 | 1/2008 |

OTHER PUBLICATIONS

PCT/US/2011/056891—Notification of Transmittal of the International Search Report and the Written Opinion of the International Searching Authority, International Search Report and Written Opinion, dated May 15, 2012.
European Patent Office, "Extended European Search Report and the European Search Opinion—EP2633198", dated Dec. 9, 2016.

* cited by examiner

SYSTEM AND COOLING FOR RAPID PRESSURIZATION OF A MOTOR-BEARING COOLING LOOP FOR A HERMETICALLY SEALED MOTOR/COMPRESSOR SYSTEM

CROSS-REFERENCE TO RELATED APPLICATIONS

The present application is a national stage application of PCT Pat. App. No. PCT/US2011/056891 filed Oct. 19, 2011, which claims priority to U.S. Provisional Patent Application having Ser. No. 61/407,142, which was filed Oct. 27, 2010. These priority applications are incorporated herein in their entirety, to the extent consistent with the present application.

BACKGROUND

A motor can be combined with a compressor in a single housing to provide a motor-compressor system. Generally, the motor resides in one cavity or compartment of the housing, while the compressor resides in a separate cavity or compartment. The motor drives the compressor, typically using a shared shaft, or with two or more shafts coupled together, in order to generate a flow of compressed process gas. In hermetically sealed units, the shaft is typically supported by two or more magnetic journal bearings and often includes additional magnetic bearings for thrust compensation.

Magnetic bearings and the electric motor are susceptible to damage if they come into contact with unfiltered or "dirty" process gas (i.e., the gas being compressed by the compressor). Such process gas can include any number of damaging materials, such as dirt, metal, oil, water, particulate matter, or the like. To avoid the motor and bearings coming into contact with dirty process gas, shaft seals are installed between the compressor and the bearings. These seals are typically fed with seal gas, such as filtered process gas, at a pressure slightly higher than the pressure within the compressor. The seal gas thus precludes dirty process gas from leaking into and past the seals.

Seal gas is often made up of gas taken from the discharge of the compressor. Accordingly, if the compressor does not provide sufficient process gas at the required pressure to feed the seals, the seals may become ineffective, allowing dirty process gas to leak and come into contact with the motor and bearings. One example of when this can occur is during settle out after a shutdown, in which the process side reaches a pressure level that is higher than the seal gas injection pressure. Unless the pressure differential across the seals is rapidly reversed, this dirty process gas may contact the bearings and/or the motor, potentially damaging one or both of these components. Furthermore, a lack of seal gas pressure may result in a large pressure differential across the seals, which can damage the seals themselves.

What is needed is an efficient system and method for rapidly pressurizing the motor compartment and bearings to keep the dirty process gas from contacting the motor and bearings in situations where the seal gas becomes insufficient.

SUMMARY

Embodiments of the disclosure may provide a motor-compressor system. The system may include a compressor configured to receive a process gas at a suction pressure and to discharge the process gas via an outlet, a motor coupled to the compressor via a rotatable shaft to drive the compressor, and a housing having a motor compartment in which the motor is disposed and a compressor compartment in which the compressor is disposed. The system may also include a bearing coupled to the housing and configured to support the shaft, a shaft seal arranged between the compressor and the bearing, and a seal gas system fluidly communicating with the motor compartment via a motor pressurization line, with the outlet of the compressor, and with the shaft seal, the seal gas system being configured to receive the process gas from the outlet of the compressor and to supply seal gas at a seal gas supply pressure to the shaft seal. The system may further include a motor pressurization valve coupled to the motor pressurization line, and a controller configured to open the motor pressurization valve at start-up to supply seal gas to the motor compartment and to pressurize the motor compartment when a difference between the seal gas supply pressure and the suction pressure is indicative of the seal gas supply pressure being insufficient.

Embodiments of the disclosure may further provide a method for preventing leakage of dirty process gas across a seal in a motor-compressor system. The method may include opening a motor pressurization valve coupled to a motor pressurization line to initially pressurize a motor compartment in which a motor of the motor-compressor system is housed, closing the motor pressurization valve prior to or during normal operation of the motor-compressor system, and sealing the motor-compressor system by providing seal gas to the seal at a seal gas pressure. The method may also include measuring a suction pressure upstream from a compressor of the motor-compressor system, and reopening the motor pressurization valve to increase a pressure in the motor compartment when the seal gas pressure is not greater than the suction pressure by an amount required to seal the motor-compressor system.

Embodiments of the disclosure may further provide a computer-readable medium having stored thereon computer-executable instructions which, when executed by a processor of a computer system, cause the processor to perform a method. The method may include opening a motor pressurization valve to pressurize a motor compartment and a cooling system of a motor-compressor system with seal gas, closing the motor pressurization valve prior to normal operation of the motor-compressor system, and monitoring a pressure differential between a suction pressure and a seal gas pressure. The method may also include reopening the motor pressurization valve to pressurize the motor compartment and the cooling system when the pressure differential is indicative of insufficient seal gas pressure.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
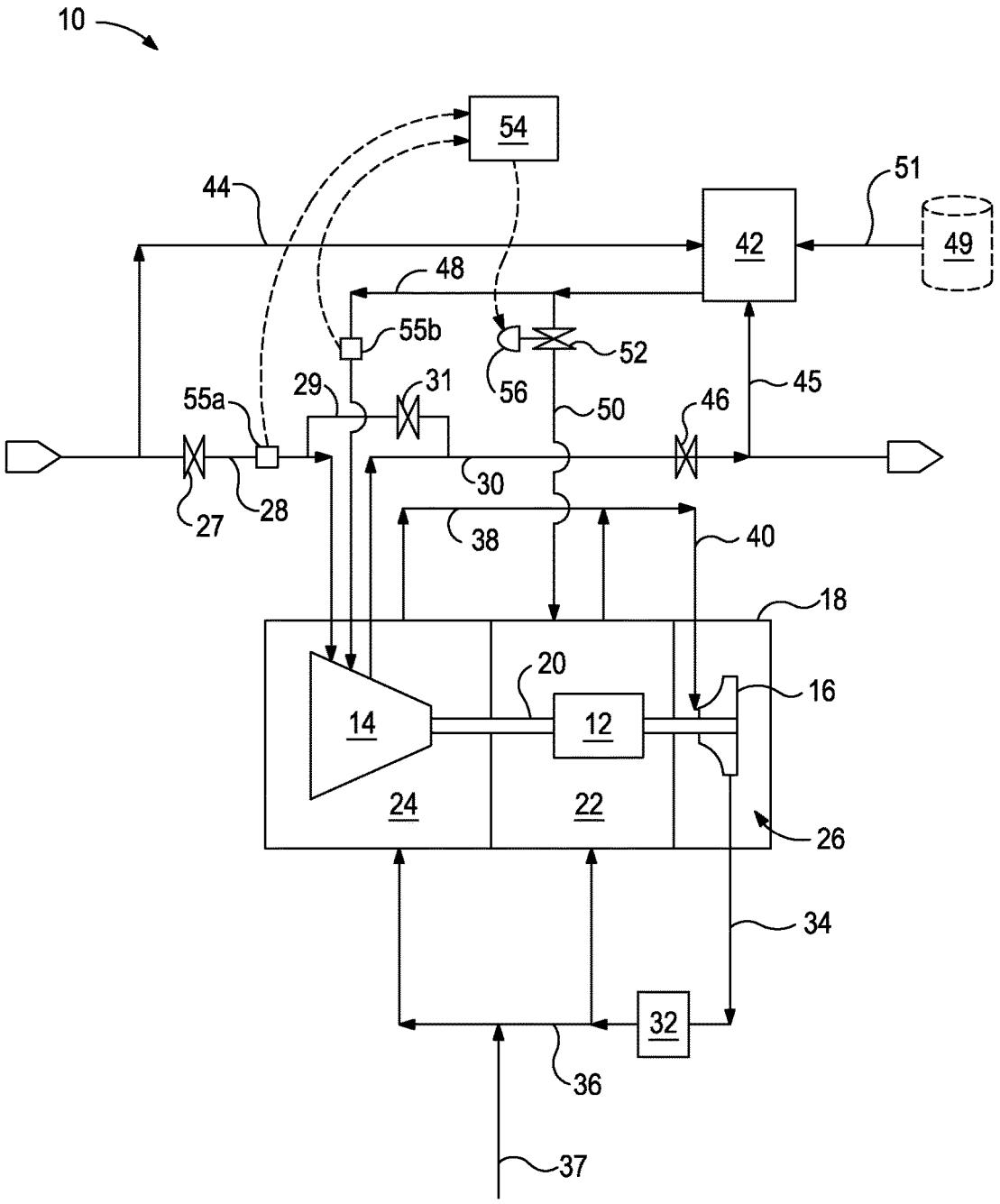
FIG. 1 illustrates a schematic view of an exemplary motor-compressor system, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a motor-compressor system 10, according to one or more embodiments. The motor-compressor system 10 includes a motor 12, a compressor 14, and a blower 16, all of which may be arranged in a housing 18. The motor 12, compressor 14, and blower 16 may be operatively connected together via one or more shafts 20, such that the motor 12 drives both the compressor 14 and the blower 16. Although not shown, in other embodiments, the motor 12 may be used in combination with a second, separate motor (not shown) to drive the blower 16 and/or the compressor 14.

As shown, the motor 12, compressor 14, and blower 16 may each be disposed in compartments 22, 24, 26, respectively, of the housing 18. Accordingly, each compartment 22, 24, 26 may be open on at least one side to allow the shaft 20 to connect to the component 12, 14, 16 residing therein. In various embodiments, the housing 18 may be hermetically sealed. Additionally, although illustrated within the housing 18, it will be appreciated that the blower 16 may reside outside of the housing 18, without departing from the scope of this disclosure. For example, the blower 16 may be attached to the outside of the housing 18 or may be a separate, stand-alone device.

The compressor 14 is fluidly coupled to a process gas inlet line 28 to receive process gas from a location upstream. An inlet shutdown valve 27 may be fluidly coupled to the process gas inlet line 28 to stop or allow the flow of process gas to the compressor 14. The compressor 14 is also fluidly coupled to a process gas discharge line 30. The combination of the process gas inlet line 28, the compressor 14, and the process gas discharge line 30 at least partially define the primary flow path for the process gas through the motor-compressor system 10. An anti-surge line 29 may extend between the process gas inlet line 28 and the process gas discharge line 30. An anti-surge valve 31 may be fluidly coupled to the anti-surge line 29 to control the flow of fluid therethrough.

The compressor 14 may be a single-stage, multistage, back-to-back, or otherwise configured centrifugal compressor. Examples of such compressors are found in the DATUM® product line of centrifugal compressors, which are commercially-available from Dresser-Rand Company. Other centrifugal compressors or other types of compressors, however, may also be used in the motor-compressor system 10. Furthermore, the compressor 14 may be a combination or train of centrifugal or other types of compressors.

The motor 12 may be an electric motor, such as an induction motor having a stator and a rotor (e.g., one or more permanent magnets), as will be described in greater detail below. Other embodiments may employ other types of electric motors 12 such as synchronous, permanent magnet, brushed DC motors, etc.

The motor-compressor system 10 also includes a cooling system that feeds cooling gas to the motor 12 and bearings (not shown) of the motor-compressor system 10 during operation. The cooling system may be characterized as forming a closed-loop, meaning that all or substantially all of the cooling gas remains in the cooling system and is recycled for continuous use. In one embodiment, the cooling system includes a cooling gas processing assembly 32, which is fluidly coupled to the blower 16 and receives pressurized cooling gas therefrom via a blower discharge line 34. The cooling gas processing assembly 32 is also fluidly coupled to a cooling gas return line 36. The cooling gas return line 36 fluidly communicates with the compressor compartment 24 and the motor compartment 22 to supply cooling gas from the cooling gas processing assembly 32 thereto. Further, the cooling system includes a cooling gas suction line 38, which is fluidly coupled to the motor compartment 22 and the compressor compartment 24, and receives spent cooling gas therefrom. The cooling gas suction line 38 is also fluidly coupled to a blower suction line 40, which fluidly couples to the blower 16, thereby feeding spent cooling gas received from the motor and compressor compartments 22, 24 to the blower 16.

The cooling system may also include a make-up gas line 37, which may be fluidly coupled to the cooling gas return line 36, as shown, or another component of the cooling system. The make-up gas line 37 may also be fluidly coupled to a source of cooling gas (not shown), to thereby provide additional cooling gas to the cooling system when necessary. The source of cooling gas may be a location downstream from the discharge valve 46, may be a gas containment vessel (not shown), or may be any other suitable source of cooling gas.

The cooling gas processing assembly 32 includes one or more components configured to convert spent cooling gas into usable cooling gas. For example, the cooling gas processing assembly 32 may include one or more filters, one or more heat exchangers, one or more separators (rotary or static) and/or the like. Further, although the cooling gas processing assembly 32 is illustrated as being fluidly coupled to the blower discharge line 34, it will be appreciated that this positioning is merely exemplary and is not to be considered limiting. Indeed, the cooling gas processing assembly 32 may be fluidly coupled directly to the process gas suction line 38 instead of the blower discharge line 34. Moreover, since the cooling gas processing assembly 32 may include several components, one or more of these components may be fluidly coupled directly to the cooling gas suction line 38, while others are fluidly coupled directly to the blower discharge line 34. In such embodiments, the spent cooling gas is partially processed, for example, cooled, by the cooling gas processing assembly 32 components prior to returning to the blower 16 via the blower suction line 40, with any remaining processing occurring in the cooling gas processing assembly 32 components located downstream from the blower 16.

The motor-compressor system 10 also includes a seal gas system. The seal gas system includes a seal gas processing assembly 42. In one or more embodiments, the seal gas processing assembly 42 and the cooling gas processing assembly 32 may be provided on a common gas conditioning skid; however, in other embodiments, these assemblies 32, 42 may be separate, as shown. The seal gas processing assembly 42 may include a duplex filtration system (not shown), allowing for online filter replacement or repair. In other embodiments, the seal gas processing assembly 42 may include any other suitable filtration system. Although not shown, the seal gas processing assembly 42 may also include a heat exchanger to regulate the temperature of gas flowing in the seal gas system. Additionally, the seal gas processing assembly 42 may include a pressure regulating valve (not shown) for supplying the seal gas at an optimum pressure relative to a suction pressure in the process gas inlet line 28, as described in greater detail below. Further, the seal gas processing assembly 42 may include any other suitable components, such as orifices, valves, pumps, or the like (none shown).

The seal gas processing assembly 42 may be fluidly coupled to the process gas inlet line 28 via an initial pressurization line 44. The seal gas processing assembly 42 may also be fluidly coupled to the process gas discharge line 30 via a primary seal gas source line 45, for example, downstream from a discharge shutdown valve 46. The seal gas processing assembly 42 may also be fluidly coupled to the compressor 14 via a seal gas supply line 48. Further, in at least one embodiment, a secondary source of seal gas 49 may be fluidly coupled to the seal gas processing system 42 via a secondary seal gas supply line 51. In an exemplary embodiment, the secondary source of seal gas 49 may be a pressurized containment vessel. As emphasized by the dashed representation, however, the secondary source of seal gas 49 may be omitted and, instead, the secondary seal gas supply line 51 may connect to another location downstream from the discharge shutdown valve 46.

A motor pressurization line 50 is fluidly coupled to the seal gas supply line 48. Although not shown, in other embodiments, the motor pressurization line 50 may instead or also be fluidly coupled directly to the seal gas processing assembly 42. A motor pressurization valve 52 may be fluidly coupled with the motor pressurization line 50 to control a flow of fluid therethrough. The motor pressurization line 50 may be fluidly coupled with the motor compartment 22 and configured to enable a relatively high flow rate of fluid therethrough to rapidly pressurize the motor compartment 22 with seal gas.

The motor-compressor system 10 also includes a controller 54. The controller 54 may be electrically coupled to a first pressure transducer 55*a*, or another type of pressure-sensing device, positioned and configured to measure the pressure in the process gas inlet line 28, for example. The controller 54 may also be electrically coupled to a second pressure transducer 55*b*, or another type of pressure-sensing device, and positioned and configured to measure pressure in the seal gas supply line 48, for example. It will be appreciated that the second pressure transducer may instead or also be positioned to measure the seal gas pressure in at least one of lines 30 and 45, without departing from the scope of this disclosure. The controller 54 may also be operably coupled to the motor pressurization valve 52, for example, via a valve actuator 56 operable to open and close the motor pressurization valve 52.

Figure 2:
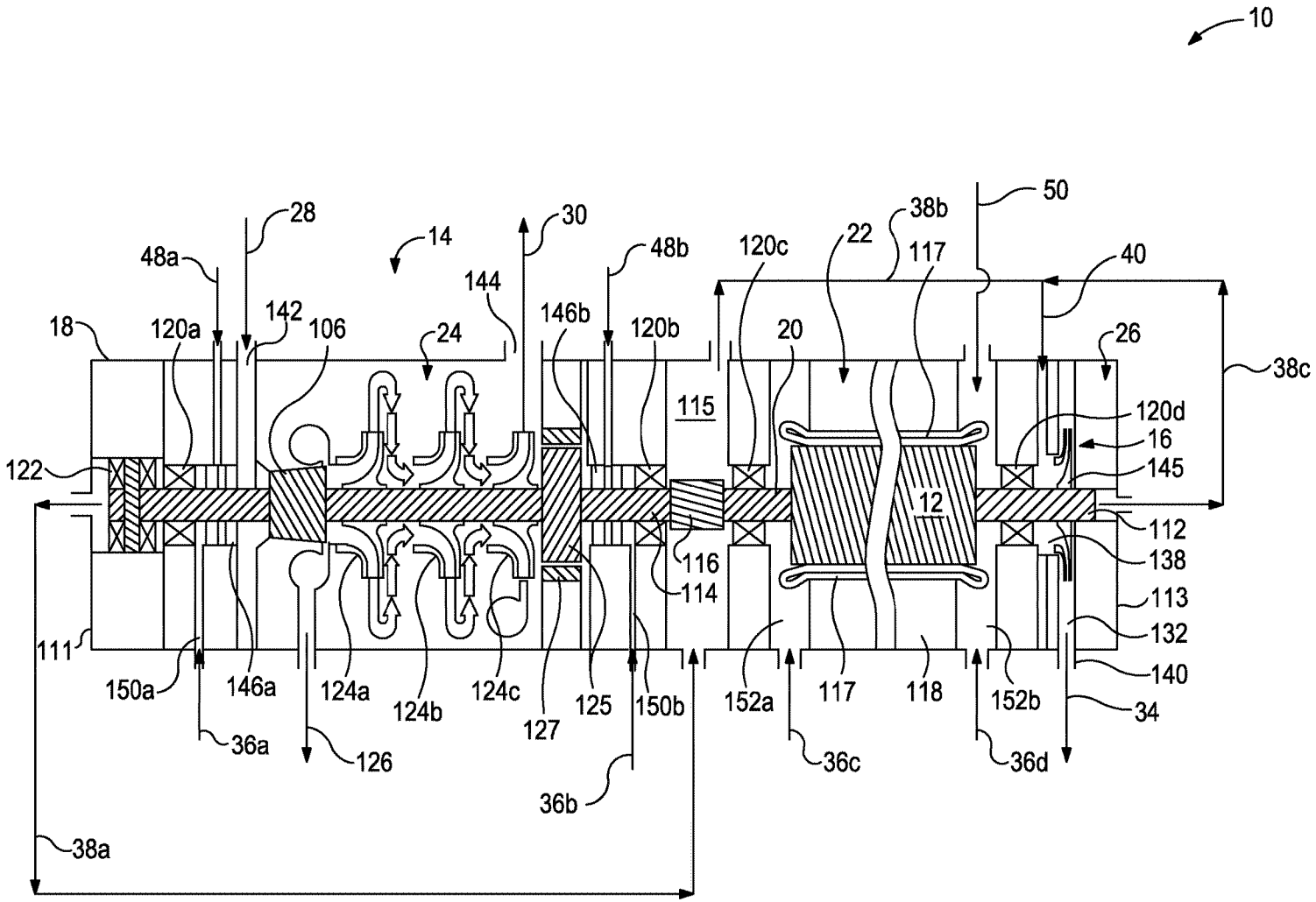
FIG. 2 illustrates a more detailed schematic view of the motor and compressor of the motor-compressor system, according to one or more embodiments.

FIG. 2 illustrates a more-detailed schematic view of the motor 12, compressor 14, and blower 16 of the motor-compressor system 10, according to one or more embodiments. In an exemplary embodiment, the motor-compressor system 10 may be the same as or similar to the motor-compressor system disclosed in U.S. Patent Application Ser. No. 61/407,059, the entirety of which is incorporated herein by reference to the extent not inconsistent with this disclosure.

As illustrated in FIG. 2, the motor 12 is coupled to the compressor 14 via the shaft 20. Additionally, the motor-compressor system 10 may include a rotary separator 106 coupled to the shaft 20, such that the motor-compressor system 10 is an integrated compression system. Examples of such integrated compression systems are commercially-available from Dresser-Rand Company. In other embodiments, the separator 106 may be provided apart from the motor-compressor system 10, may be a static separator, or may be omitted altogether. In an exemplary embodiment, the motor 12, compressor 14, blower 16, and separator 106, may each be positioned within the housing 18, with the motor 12 in the motor compartment 22, the compressor 14 and separator 106 in the compressor compartment 24, and the blower 18 in the blower compartment 26.

The housing 18 may have a first or compressor end 111, and a second or motor end 113. The shaft 20 extends substantially the whole length of the housing 18, from the compressor end 111 to the motor end 113, and includes a motor rotor section 112 and a driven section 114. As illustrated, the motor rotor section 112 of the shaft 20 forms part of the motor 102 and includes the rotating portion thereof. The driven section 114 of the shaft 20 includes the rotor of the compressor 14 and the shaft mounted separator 106. Further, the motor rotor section 112 and driven section 114 may be connected via a coupling 116, such as a flexible coupling. In other embodiments, a rigid coupling may be used instead or additionally. Accordingly, the motor 12 rotates the motor rotor section 112, which transmits the rotation to the drive section 114 via the coupling 116. In at least one embodiment, the coupling 116 may be disposed within a cavity 115 defined within the housing 18.

In an embodiment in which the motor 12 is an electric motor, the motor 12 may have a shaft that uses an induction type principle (with a squirrel cage arrangement) or may have permanent magnets 117 mounted on the shaft and a stator 118. The motor rotor section 112 and driven section 114 of the shaft 20 may be supported at each end, respectively, by one or more radial bearings (four shown: 120*a*, 120*b*, 120*c*, 120*d*). The radial bearings 120*a-d* may be directly or indirectly supported by the housing 18 and provide support to the rotor and driven sections 112, 114, during normal operation of the motor-compressor system 10. In one embodiment, one, two, three, or more of the bearings 120*a-d* may be magnetic bearings, such as actively-controlled or passive magnetic bearings. In addition, at least one axial thrust bearing 122 may be provided at or near the end of the shaft 20 adjacent the compressor end 111 of the housing 18. In one embodiment, the axial thrust bearing 122 is a magnetic bearing. The axial thrust bearing 122 is configured to bear axial thrust force generated by pressure differential in the process gas created by the compressor 14. In yet another embodiment, the motor 102 may also have a separate axial thrust bearing (not shown) to support any axial loads generated in the motor 102.

As shown, the motor-compressor system 10 has a suction inlet 142 and a discharge outlet 144. The suction inlet 142 is fluidly coupled to the process gas inlet line 28 and the discharge outlet 144 is fluidly coupled to the process gas discharge line 30. Between the inlet 142 and the outlet 144, the compressor 14 may include one or more impellers (three shown: 124*a*, 124*b*, 124*c*) for compressing the process gas. As can be appreciated, however, any number of impellers may be used without departing from the scope of the disclosure. Furthermore, the separator 106 may be arranged upstream from the impellers 124*a-c* to separate and remove higher-density components from lower-density components contained within the process gas. The higher-density components (e.g., liquids) removed from the process gas can be discharged from the separator 106 via a separator discharge line 126, leaving a relatively dry (e.g., substantially gaseous) process gas to be introduced into the compressor 14. Especially in subsea applications where the process gas is commonly multiphase, any separated liquids discharged via the separator discharge line 126 may accumulate in a collection vessel (not shown) and subsequently be pumped back into the process gas at a pipeline location downstream of the compressor 14. Otherwise, separated liquids may be drained into the collection vessel or otherwise removed from the integrated motor-compressor system 10.

A balance piston 125, including an accompanying balance piston seal 127, may be arranged around the shaft 20 between the motor 12 and the compressor 14. Due to the pressure rise developed through the compressor 14, a pressure difference between the suction inlet 142 and the discharge outlet 144 is created; as a result, the compressor 14 has a net thrust in the direction of the compressor side 111 of the housing 18. To compensate, gas from upstream of the first impeller 124*a* may be fed to the balance piston 125, on the side of the balance piston 125 facing the motor 12. This provides a second pressure differential, applied across the balance piston 125, which counteracts the thrust force generated by the impellers 124*a-c*. As can be appreciated, any thrust not absorbed by the balance piston 125 may be absorbed by the thrust bearing(s) 122.

In an exemplary embodiment, the blower 16 is arranged on the shaft 20 proximal the motor end 113 of the housing 18. During operation, the shaft 20 may cause an impeller 145 of the blower 16 to rotate, thereby generating the head pressure required to circulate a cooling gas through the cooling system. Further, the cooling system may be configured to regulate the temperature of the motor 12 and bearings 120*a-d*, 122. The blower 16 may include at least one diffuser 132 coupled to the impeller 145. Although not shown, the diffuser 132 may form a volute or other suitable structure for discharging cooling gas from the impeller 145. During operation, the diffuser 132 may serve as a pressure-containing boundary defining an inlet 138 for introducing cooling gas into the impeller 145, and a diffuser outlet 140 for discharging the cooling gas in the blower discharge line 34.

The blower 16 may be disposed within the housing 18, as shown. In other embodiments, the blower 16 may be bolted directly onto the motor end 113 of the housing 18 (i.e., the exterior of the housing 18) using the existing bolt pattern provided to hermetically-seal the motor 12 within the housing 18. In other embodiments, the blower 16 may be coupled to or disposed in the housing 18 in any other manner or configuration suitable.

The cooling system may also include one or more internal cooling passages (four shown: 150*a*, 150*b*, 152*a*, 152*b*). The internal cooling passages 150*a,b* are defined in the compressor compartment 24 are in fluid communication with the bearings 120*a,b*, which are proximal the compressor 14. The internal cooling passages 150*a,b* are also in fluid communication with the cooling gas return line 36 (FIG. 1), which, as shown in FIG. 2, may be divided into two branches 36*a*, 36*b*. The internal cooling passages 152*a,b* are defined in the motor compartment 22 are arranged proximal to the motor 12, and are in fluid communication with the bearings 120*c,d*. The internal cooling passages 152*a,b* receive cooling gas from branches 36*c* and 36*d* of the cooling return line 36 (FIG. 1). It will be appreciated that additional or fewer internal cooling passages may be defined in the housing 18 without departing from the scope of this disclosure.

Further, as shown, the motor compartment 22 is fluidly coupled with the motor pressurization line 50. In one embodiment, as illustrated, the motor pressurization line 50 is fluidly coupled directly to the internal cooling passage 152*b*; however, this is just one example among many contemplated herein. Indeed, although not shown, the motor pressurization line 50 may be fluidly coupled to the internal cooling passage 152*a*, the cooling gas return line 36 (e.g., either branch 36*c* or 36*d*), or may be fluidly coupled at any other position, with any other component, such that the motor pressurization line 50 is fluidly coupled to the motor compartment 22 with a minimum number of intervening structures.

The motor-compressor system 10 may also include one or more buffer seals (two are shown: 146*a*, 146*b*). The buffer seals 146*a,b* are configured and positioned to contain the process gas within the housing 18 and to prevent dirty process gas from leaking into communication with the bearings 120*a-d* and the motor compartment 22. The buffer seals 146*a,b* may be radial seals arranged at or near each end of the driven section 114 of the shaft 20 and inboard of the bearings 120*a,b*, so as to contain the pressurized process gas in the compressor 14. In one or more embodiments, the buffer seals 146*a,b* may be brush seals, labyrinth seals, dry gas seals, carbon ring seals, or any combination thereof. In one embodiment, the buffer seals 146*a,b* receive a feed of pressurized seal gas via lines 48*a,b*, which are branches of seal gas supply line 48 (FIG. 1).

Referring now to FIGS. 1 and 2, in exemplary normal operation of the motor-compressor system 10, the motor 12 may be configured to rotate the shaft 20, thereby driving the compressor 14, the blower 16, and the separator 106. The controller 54 may open the inlet and discharge shutdown valves 27, 46 such that process gas to be compressed is introduced into the motor-compressor system 10 via the process gas inlet line 28, and is then introduced to the separator 106 via the inlet 142. The process gas may include a hydrocarbon gas, such as natural gas or methane, to name just two examples. In other embodiments, the process gas may include air, $CO_2$, $N_2$, ethane, propane, i-$C_4$, n-$C_4$, i-$C_5$, n-$C_5$, or the like, and/or combinations thereof. In at least one embodiment, especially in undersea oil and gas applications, the process gas may be a "wet" process gas having both liquid and gaseous components, or otherwise including a mixture of higher-density and lower-density components.

The separator 106 separates out a higher-density component of the process gas, for example, substantially all of any liquid that is entrained in the process gas. The liquid and/or other higher-density components extracted from the process gas by the separator 106 are removed via the discharge line 126, as described above. Accordingly, the separator 106 may provide a dry process gas to the compressor 14, specifically, to the first impeller 124*a*. Further, although not shown, a portion of the dry process gas may be bled off from the suction inlet 142 and/or the outlet of the separator 106 and fed on the side of the balance piston 125 that faces the motor 12, to counter axial thrust forces oriented toward the motor end 111 of the housing 18. After proceeding through the separator 106, the process gas not bled off to the balance piston 125 is compressed by the compressor 14 and discharged through the discharge outlet 144 to the process gas discharge line 30.

During such normal operation, both the seal gas system and the cooling system may also be operating. Accordingly, during operation of the seal gas system, a portion of the discharge process gas in the process gas discharge line 30 may be diverted to the seal gas processing assembly 42 via the primary seal gas source line 45. In the seal gas processing assembly 42, the diverted process gas is filtered, cooled, pressurized, and/or otherwise processed to provide seal gas. The seal gas is routed from the seal gas processing assembly 42, through the seal gas supply line 48, including the branch lines 48*a,b* (FIG. 2), to the buffer seals 146*a,b*. As described above, the process gas, prior to compression in the compressor 14, is also fed to the side of the balance piston 125 that faces the motor 12; accordingly, the pressure on the inboard side of both seals 146*a,b* is approximately the pressure of the process fluid at the suction inlet 142. Therefore, the seal gas is supplied to the buffer seals 146*a,b* at a pressure that is slightly higher than the pressure of the process gas at the suction inlet 142. For example, the seal gas may be provided at a pressure that is about 0.7 bar, about 1 bar, or about 1.5 bar, or more, greater than the pressure of the process gas at the suction inlet 142.

During normal operation of the cooling system, the temperature of the motor 12 and the bearings 120*a-d*, 122 is regulated to avoid damage and maximize efficiency. Specifically, cooling gas may be circulated from the blower 16, through internal cooling passages 150*a*, 150*b*, 152*a*, and 152*b*, and eventually returned to the blower 16 to complete the cooling loop. In one or more embodiments, the cooling gas may be the same as the seal gas. In other embodiments, the cooling gas, seal gas, and process gas may all be the same fluid, which may prove advantageous in maintaining and designing any auxiliary systems. In yet other embodiments, the cooling gas may be an inert gas.

The blower 16 of the cooling system may be adapted to immerse the motor 12 and bearings 120*a-d* in an atmosphere of pressurized cooling gas. Since the impeller 145 of the blower 16 may be fluidly coupled directly to the motor rotor section 112 of the shaft 20, the impeller 145 may operate as long as the motor 12 is in operation and driving the shaft 20. As the impeller 145 rotates, it draws in the cooling gas through the inlet 138 and into the impeller 145. Within the diffuser 132, the cooling gas is compressed and ultimately ejected from the blower 16 via the diffuser outlet 140 and into blower discharge line 34.

As the cooling gas nears the bearings 120*a,b*, the buffer seals 146*a,b* generally prevent the cooling gas from passing into the separator 106 or compressor 14. Instead, the cooling gas may freely pass through the bearings 120*a,b*, e.g., through a gap (not shown) formed between each bearing 120*a,b* and the shaft 20. As the cooling gas passes through the bearings 120*a,b*, heat is drawn away from the bearings 120*a,b* to cool or otherwise regulate the temperature thereof.

The cooling gas coursing through the internal cooling passage 150*a* may also cool the axial thrust bearing 122 as the cooling gas channels toward the compressor end 111 of the housing 18 and ultimately discharges into a branch line 38*a* of the cooling gas suction line 38 (FIG. 1). The cooling gas coursing through internal cooling passage 150*b* may cool the bearing 120*b* adjacent the coupling 116 and then escape into the cavity 115. In one embodiment, the cavity 115 may also be configured to receive the cooling gas from the internal cooling passage 150*a* that is discharged from the compressor end 111 of the housing 18 via line 38*a*. Accordingly, the cooling gas channeled through both internal cooling passages 150*a,b* may be once again combined or otherwise mixed within the cavity 115.

In one or more embodiments, the cooling gas in line 36 (FIG. 1) may be split into the branch lines 36*c,d* (FIG. 2) or otherwise introduced into the internal cooling passages 152*a,b* to cool the motor 12 and also the bearings 120*c,d* that support to the motor rotor section 112 of the shaft 20. The cooling gas may exit the internal cooling passages 152*a,b* through the bearings 120*c,d*, e.g., through a gap (not shown) formed between each bearing 120*c,d* and the shaft 20, and thus remove at least a portion of the heat generated by the motor 12 and the bearings 120*c,d*. On one side of the motor 12 (e.g., the left side as shown in FIG. 1), the cooling gas may be discharged through the bearing 120*c* and into the cavity 115, where it is mixed or otherwise combined with the cooling gas discharged from the internal cooling passages 150*a,b*. The cooling gas collected in the cavity 115 may then be discharged from the housing 18 via another branch 38*b* of the cooling gas return line 38 (FIG. 1). On the other side of the motor 12 (e.g., the right side as shown in FIG. 1), the cooling gas may also be discharged from the housing 18 and into still another branch 38*c* of the cooling gas return line 38. In various embodiments, the branch 38*c* may also be referred to as a balance line. It will be appreciated that directional terms such as "right" and "left" are used herein for ease of description with reference to the Figures, but are not meant to limit the scope of this disclosure.

Furthermore, during normal operation, the pressure in the process gas inlet line 28 may fluctuate for a variety of different reasons, including starting, stopping, or changing in the operation of other compression systems running in parallel or in series with the motor-compressor system 10. As noted above, however, the seal gas supplied to the buffer seals 146*a,b* is determined based on the pressure of the process gas in the process gas inlet line 28. To account for these fluctuations, and thereby minimize transient pressure differentials across the buffer seals 146*a,b*, make-up gas may be supplied to the cooling system via the make-up gas supply line 37. Accordingly, when desired, make-up gas can be supplied to one or more of the interior cooling passages 150*a,b*, 152*a,b* to account for inlet pressure variations.

Apart from normal operation, the motor-compressor system 10 also has a start-up operation. Prior to introducing process gas to the compressor 14, it may be advantageous to supply an initial source of seal gas to at least the buffer seals 146*a,b* and/or the motor compartment 22. This may attenuate the potential for pressure differentials across the seals 146*a,b* during start-up by bringing the motor compartment 22 and the buffer seals 146*a,b* to an elevated pressure prior to the primary source of seal gas pressure being fully operational.

Accordingly, during start-up operation, the seal gas processing assembly 42 may receive an initial source of seal gas via the initial pressurization line 44. After the initial seal gas is processed, it is fed to the buffer seals 146*a,b* via the seal gas supply line 48. Further, the controller 54 may signal to the actuator 56 to open the motor pressurization valve 52. Thereafter, the seal gas may be supplied to the motor compartment 22 via the motor pressurization line 50.

The initial source of seal gas may be a location that is upstream from the motor-compressor system 10, for example, upstream from the inlet shutdown valve 27. In other embodiments, the source of initial seal gas may be the secondary source of seal gas 49, a location downstream from the downstream shutdown valve 46, or both. Further, in various embodiments, the initial seal gas may already be clean and may bypass one or more components of the seal gas processing assembly 42.

After the start-up operation has completed, for example, when generally steady-state normal operation is reached, the controller 54 may signal the motor pressurization valve 52 to shut. As such, the initial source of seal gas may be substituted for the primary seal gas supply via the primary gas seal gas source line 45.

In various situations, the pressure in the seal gas supply line 48 may drop more drastically than expected during normal operation, for longer periods, or both. One example of this is a shutdown of the motor-compressor system 10. During a shutdown, the pressure in the compressor compartment 24 reaches a "settle out" point, which is between the pressures seen in the process gas inlet line 28 and the process gas discharge line 30 during normal operation. Accordingly, even if fully-supplied, the pressure of the seal gas supplied to the buffer seals 146*a,b*, which may be only slightly higher than the pressure of the process gas in the process gas inlet line 28, may be insufficient to stop the migration of dirty process gas across the buffer seals 146*a,b*. Furthermore, the seal gas supply during normal operation may be the process gas discharged from the compressor 14; therefore, during a shutdown event, the source of seal gas may be ineffective.

Another example of such a situation is a compressor surge. During surge conditions, the flow through the compressor 14 approaches a critical point after which flow in the motor-compressor system 10 reverses. This can be damaging to the compressor 14. To substantially avoid this, the anti-surge line 29 may be employed. For example, when the motor-compressor system 10 approaches surge conditions, the anti-surge valve 31 opens and flow is shunted from the process gas discharge line 30 back to the process gas inlet line 28 via the anti-surge line 29. Although this avoids surge, it may increase the pressure of the process fluid proximal the suction inlet 142 of the compressor 14, resulting in a pressure differential across the buffer seals 146*a,b*. This can damage the buffer seals 146*a,b*, and/or allow the dirty process gas to migrate across the buffer seals 146*a,b*.

To mitigate the potential for dirty process gas communicating with the bearings 120*a-d*, 122, the controller 54 monitors the pressure in the primary seal gas source line 45 and the process gas inlet line 28. When the pressure in the seal gas supply line 48 is insufficient to enable the buffer seals 146*a,b* to operate effectively, the controller 54 signals the actuator 56 to open the motor pressurization valve 52, thereby rapidly injecting seal gas into the motor compartment 22. This may reduce or otherwise eliminate the pressure differential between the suction pressure and the pressure in the motor compartment 22, thereby slowing or eliminating the migration of dirty process fluid and reducing the potential for damage to the buffer seals 146*a,b*. To further attenuate or eliminate the migration of dirty process fluid, the secondary source of seal gas 49 may be used. Thus, pressurized seal gas from the secondary source 49 may be injected into the motor compartment 22 via the secondary seal gas source line 51, the seal gas conditioning assembly 42, the seal gas supply line 48, and the motor pressurization line 50. Further, since the motor compartment 22 and the interior cooling passages 150*a,b* of the compressor compartment 24 are fluidly coupled via the cooling system, the pressurization of the motor compartment 24 may increase the pressure in the interior passages 150*a,b*, thereby reducing the pressure differentials across the buffer seals 146*a,b*.

Embodiments generally described herein advantageously provide for rapid pressurization of the motor compartment 22 and the cooling system during a shutdown, a surge, and/or other situations in which the suction pressure significantly varies. By providing for rapid pressurization via motor compartment 22 and the closed-loop cooling system, the motor-compressor system 10 avoids damage to the buffer seals 146*a,b* caused by a prolonged exposure to a large pressure differential, avoids damage to the bearings 120*a-d*, 122 by exposure to dirty process gas, and minimizes migration of dirty gas into the motor/bearing loop.

Figure 3:
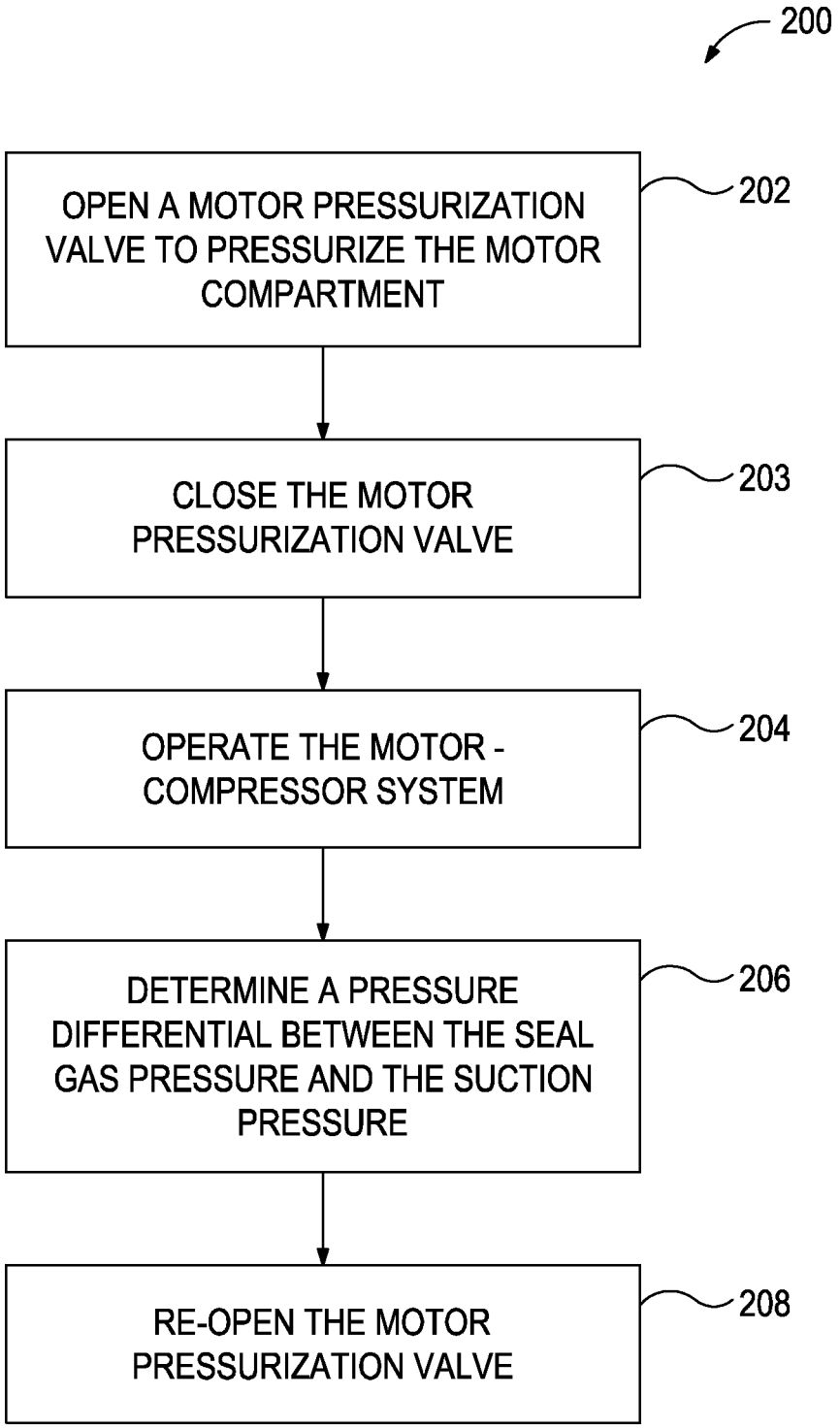
FIG. 3 illustrates a flowchart of an exemplary method for rapidly pressurizing a motor-compressor system, according to one or more embodiments.

Referring again to FIG. 1, the controller 54 may include or be part of a computer system (not shown). The computer system is configured to execute instructions stored on a non-transitory, computer-readable medium to perform a method for preventing leakage of dirty process gas across a seal in a motor-compressor system. Accordingly, FIG. 3 illustrates an example of such a method 200. The method 200 may begin by opening a motor pressurization valve to pressurize a motor compartment and a cooling system with seal gas, as at 202. The method 200 may then proceed to shutting the motor pressurization valve in anticipation of or during normal operation, as at 203. The method 200 may proceed to operating the motor-compressor system, as at 204, for example, according to a normal operation thereof. Such normal operation may include opening an inlet shutdown valve and an outlet shutdown valve to allow process gas to enter the motor-compressor system for compression.

Normal operation includes supplying a seal gas to shaft seals in the motor-compressor system. Further, normal operation includes cooling the motor and bearings of the motor-compressor system using a closed-loop cooling system. Additionally, such normal operation may include handling fluctuations in a suction pressure of a compressor disposed in the motor-compressor system. The motor-compressor system may compensate for such suction pressure fluctuations by increasing or decreasing a seal gas pressure of seal gas supplied to shaft seals and/or may pressurize a cooling system using make up gas.

Furthermore, the controller may determine the pressure differential between the suction pressure and the seal gas pressure, as at 206. In one or more embodiments, to determine the pressure differential, the controller may receive a signal from a pressure sensor in the process gas inlet line to determine the suction pressure. Additionally, the controller may receive a signal from another pressure sensor located at a seal gas supply line. The controller may then compare the signals to determine the pressure differential. Additionally or instead, the controller may monitor an anti-surge valve to determine if it has been opened.

The controller may repeatedly determine the pressure differential at intervals or continuously. At some point, the controller may determine that seal gas pressure is insufficient, based on the seal gas pressure differential, for example, when the seal gas pressure is less than the suction pressure, or when the seal gas pressure is about equal to the suction pressure (e.g., is less than about 0.1 bar, about 0.2 bar, about 0.5 bar, about 0.7 bar, about 1 bar, or about 1.5 bar higher). When this occurs, the controller may signal the motor pressurization valve to re-open, as at 208. With the motor pressurization valve reopened, the motor compartment of the motor-compressor system may be rapidly pressurized with seal gas to avoid a pressure differential across the seals. Further, pressurizing the motor compartment may include transporting seal gas from the motor compartment to the bearings via the closed-loop cooling system that fluidly couples the bearings and the motor compartment.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A motor-compressor system, comprising:

a compressor configured to receive a process gas at a suction pressure and to discharge the process gas via an outlet;

a motor coupled to the compressor via a rotatable shaft to drive the compressor;

a housing having a motor compartment in which the motor is disposed and a compressor compartment in which the compressor is disposed;

a bearing coupled to the housing and configured to support the shaft;

a shaft seal arranged between the compressor and the bearing;

a seal gas system fluidly communicating with the motor compartment via a motor pressurization line, with the outlet of the compressor, and with the shaft seal, the seal gas system being configured to receive the process gas from the outlet of the compressor, and to supply seal gas at a seal gas supply pressure to the shaft seal;

a motor pressurization valve coupled to the motor pressurization line; and a controller configured to open the motor pressurization valve at start-up to supply seal gas to the motor compartment, to open the motor pressurization valve during a compressor surge to supply the seal gas to the motor compartment, and to pressurize the motor compartment when a difference between the seal gas supply pressure and the suction pressure is indicative of the seal gas supply pressure being insufficient.

2. The motor-compressor system of claim 1, wherein the controller is configured to open the motor pressurization valve during a shutdown.

3. The motor-compressor system of claim 1, wherein the shaft seal comprises a carbon ring seal and the bearing comprises a magnetic bearing.

4. The motor-compressor system of claim 1, further comprising a cooling system fluidly coupled to the bearing and the motor compartment, wherein pressurization of the motor compartment increases a pressure of the cooling system.

5. The motor-compressor system of claim 4, wherein the cooling system includes a make-up gas line, the cooling system being configured to receive pressurized gas via the make-up gas line in response to a fluctuation in the suction pressure.

6. The motor-compressor system of claim 4, wherein the cooling system includes a first interior cooling passage defined in the compressor compartment between the shaft seal and the bearing, the first interior cooling passage being in fluid communication with the motor compartment.

7. The motor-compressor system of claim 6, wherein the cooling system further includes a second interior cooling passage defined in the motor compartment, the second interior cooling passage being in fluid communication with the first interior cooling passage.

8. The motor-compressor system of claim 1, wherein the seal gas system is coupled to an initial source of seal gas upstream of the compressor.

9. The motor-compressor system of claim 1, wherein the seal gas system further comprises a pressurized gas containment vessel configured to supply pressurized gas to the motor compartment when the motor pressurization valve is opened.

10. The motor-compressor system of claim 1, wherein the seal gas system is configured to receive pressurized gas from a location downstream of the motor-compressor and to supply the pressurized gas to the motor compartment when the motor pressurization valve is opened.

* * * * *